US006280156B1

(12) United States Patent
Wirz et al.

(10) Patent No.: US 6,280,156 B1
(45) Date of Patent: Aug. 28, 2001

(54) MAGNETICALLY COUPLED ROTARY PUMP

(75) Inventors: Peter Wirz, Unterkulm (CH); Thomas Folsche, Loerrach (DE)

(73) Assignee: CP Pumpen AG, Zofingen (CH)

( * ) Notice: Subject to any disclaimer, the term of this patent is extended or adjusted under 35 U.S.C. 154(b) by 0 days.

(21) Appl. No.: 09/382,190

(22) Filed: Aug. 23, 1999

(30) Foreign Application Priority Data

Aug. 21, 1998 (CH) ..... 1727/98

(51) Int. Cl.[7] ..... F04B 17/00
(52) U.S. Cl. ..... 417/420
(58) Field of Search ..... 417/420, 410.1, 417/321, 273; 415/113; 210/408

(56) References Cited

U.S. PATENT DOCUMENTS 4,871,301 * 10/1989 Buse ..... 417/420
5,411,378 * 5/1995 Sipin ..... 417/360
5,423,661 * 6/1995 Gabeler et al. ..... 417/410.4
5,499,902 * 3/1996 Rockwood ..... 415/113
5,569,383 * 10/1996 Ark, Jr. et al. ..... 210/408
6,024,542 * 2/2000 Phillips et al. ..... 417/273
6,135,710 * 10/2000 Araki et al. ..... 415/206

* cited by examiner

*Primary Examiner*—Teresa Walberg
*Assistant Examiner*—Daniel Robinson
(74) *Attorney, Agent, or Firm*—Crowell & Moring LLP

(57) ABSTRACT

A magnetically coupled rotary pump has, in a pump chamber, a pump rotor mounted by a single slide bearing on a stationary axis of a pump bearing support. The slide bearing is formed on one side by a metal sleeve shrunk over the bearing sleeve, said sleeve being connected by means of a weld with the pump rotor, and on the other side by a bushing mounted on the pump bearing support or a one-piece slide bearing surface formed correspondingly directly on pump bearing support. With this design of the bearing, dead spaces and gaps are avoided, enabling complete cleaning and sterilization of the pump chamber with complete draining of the pump chamber. A pump of this kind is especially suitable for use in sterile applications.

16 Claims, 2 Drawing Sheets

MAGNETICALLY COUPLED ROTARY PUMP

BACKGROUND AND SUMMARY OF THE INVENTION

This application claims the priority of Swiss Application No. 1727/98, filed Aug. 21, 1998, the disclosure of which is expressly incorporated by reference herein.

The present invention relates to a magnetically coupled rotary pump.

A rotary pump of this type is known for example from European Patent application EP 0171515. Here, a pump chamber with a flying pump rotor mounted therein on a stationary axis is separated by a statically sealing can motor housing from the motor chamber. The drive motor is connected with an internal rotor fitted with permanent magnets and mounted close to the wall of the can motor housing on the motor chamber side. The pump rotor in turn is connected with an external rotor provided with permanent magnets, which is located close to the wall of the can motor housing on the pump side. In this way, a zero-contact transmission of the rotary movement of the drive motor to the pump rotor is produced, in which no problems with sealing caused by shaft seals can occur.

Pumps of this kind are used in particular for fluid media that require optimum tightness or avoidance of leaks, and in which no movable or dynamic seals are allowed, for example aggressive or toxic media. In order to drain the pump chambers of such pumps, they are usually provided with pump rotor axes that lie horizontally, with separate additional drain stubs having to be provided in the lower area of the pump chamber. These drain stubs, however, must also have to be resealed, and so-called dead spaces can occur at these points in which a residue of the medium to be delivered can remain—in other words complete emptying cannot be achieved. If such a pump is used with the pump rotor axis located vertically, it can be drained without additional drain stubs, but when operation is resumed there is the problem that the space located between the back of the pump rotor and the can motor housing cannot be vented, since no vent stubs can be located in the can motor housing itself. With a lack of venting, however, there is a danger of the pump rotor bearings running dry, which otherwise are lubricated by the medium to be delivered, thus damaging the bearing. This is the case with conventional pumps with a deep cylindrical can motor housing in which the pump rotor has at least one bearing in the inner area of the can motor housing, which in this vertical operating mode cannot be vented sufficiently when filling.

When such pumps are used for sterile techniques, they must be thoroughly cleaned when reinstalled, drained of residue, and sterilized. The pump described at the outset however meets these additional criteria insufficiently; in particular, the intake area is not free of dead spaces due to the conventional use of multi-section stationary axes and the metal threaded bushings located in the pump rotor with shrunk-on slide bearing bushings, resulting in unsatisfactory cleaning and sterilization of the pump chamber.

The goal of the present invention consists in eliminating these disadvantages and providing a pump that is especially suited for sterile applications.

This goal is achieved according to the invention by a rotary pump with a can motor housing sealing its pump chamber on the drive side from a pumped medium. On one side of the can motor housing, a motor-driven permanent magnet rotor is located and, on the other side, another permanent magnet rotor connected with a pump rotor is located. The can motor housing is connected only at its edge with the pump parts. The pump rotor, on its side facing away from the can motor housing in the hub area facing an intake channel, is rotatably mounted on a fixed axis of a pump bearing support, which is located in the intake channel and is permanently connected with the housing of the rotary pump. A bearing bushing is connected with pump rotor by means of a sleeve made of metal shrunk over the bearing bushing and, in cooperation with a bearing axis located on the pump bearing support, forms the single bearing in the form of a slide bearing of the pump rotor.

Additional preferred embodiments are described herein.

As a result of the design, according to the invention, with the pump rotor bearing on the stationary axis of the pump rotor in the form of a one-piece slide bearing which has no gaps or dead spaces (except for the bearing gap) which the medium to be delivered could penetrate, the compact pump interior can be drained completely, cleaned, and disinfected. In addition, the single bearing, when operation is resumed, is immediately flushed by the medium to be delivered and hence cannot run dry and be damaged. In addition, the remaining design as well as the bearing area, like the pump rotor, promote and support these properties in the same way. Advantageously, a very compact and simple design of the pump is thus achieved, which can be maintained and repaired if necessary in a simple fashion.

A pump according to the invention designed in this way is suitable for uses in fluid applications and especially in the field of sterile applications.

Other objects, advantages and novel features of the present invention will become apparent from the following detailed description of the invention when considered in conjunction with the accompanying drawings.

DETAILED DESCRIPTION OF THE DRAWINGS

Figure 1:
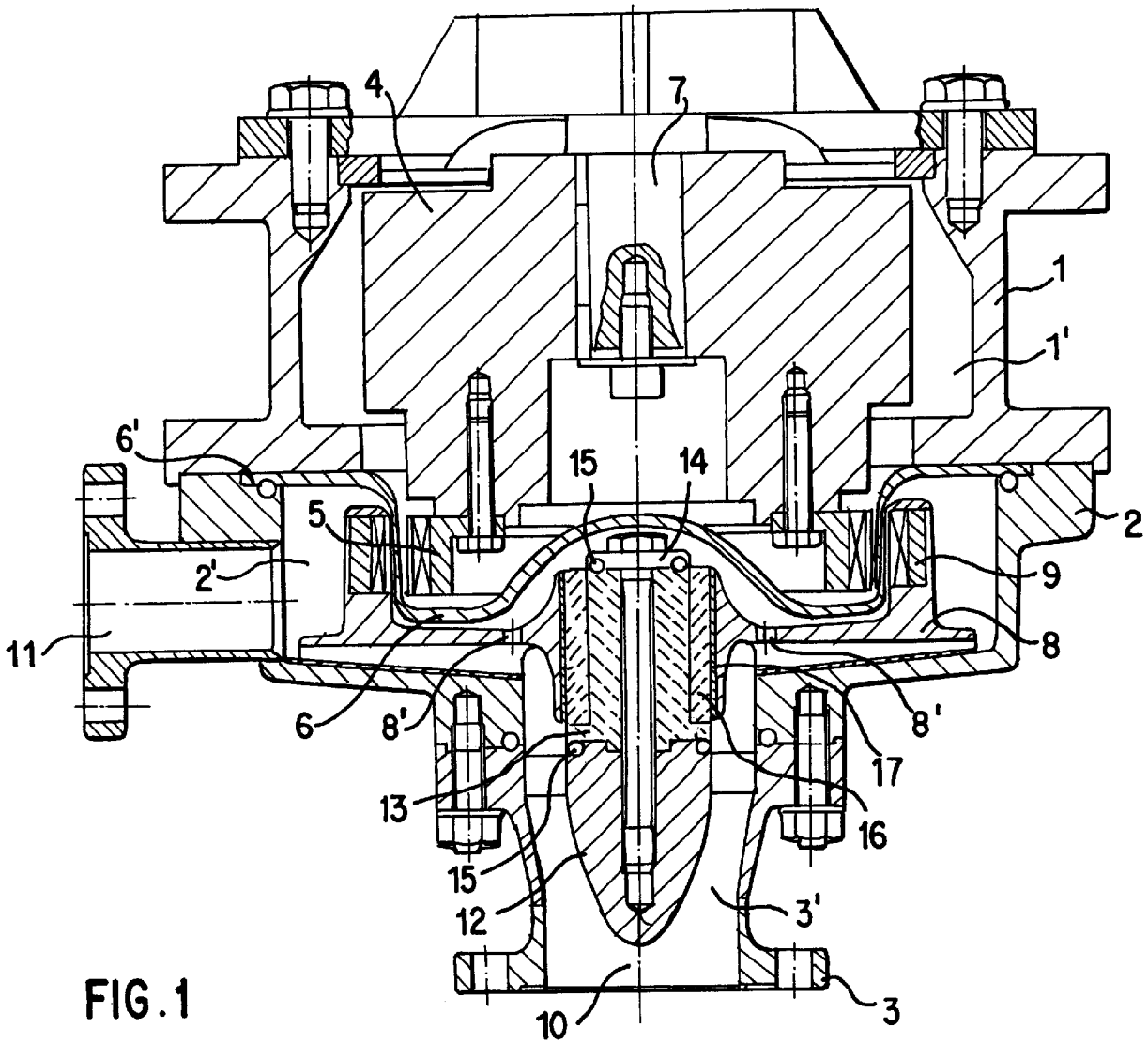
FIG. 1 shows a lengthwise section through a pump according to the invention with a multi-section screwed-together pump bearing support of the pump rotor.

FIG. 1 shows a lengthwise section through a rotary pump according to the invention with the drive housing 1, a pump housing 2, and an intake flange or stub 3 fastened thereto. In drive housing 1, a permanent magnet rotor 5 is mounted on a flywheel 4. Between the drive housing 1 and the pump housing 2, a can motor housing 6 is located. The can motor housing 6 is connected only by its edge 6' with the drive housing 1 or the pump housing 2 and separates the drive chamber 1' from the pump chamber 2' in a statically sealing fashion. Flywheel 4 is mounted on a shaft 7 with a drive motor, for example an electric motor, not shown in the figure.

A pump rotor 8 is located in pump chamber 2', said rotor 8 for example having permanent magnets 9 integrated into the body of the pump rotor, which form an external permanent magnet rotor. The two permanent magnet rotors 5 and 8, 9 are spaced apart from one another, separated by the wall of can motor housing 6, and parallel to pump axis 10. On the side of the pump rotor 8 facing away from the can motor housing 6, pump blades are formed which deliver the medium into the outer area of pump chamber 2' and carry it away through a pump outlet opening 11.

Pump rotor 8 is mounted on a fixed axis of the pump bearing support 12 which is permanently attached to pump housing 2 and whose nose terminates in the intake chamber 3' of intake stub 3.

The bearing of pump rotor 8 on pump bearing support 12 is now, according to the invention, made as follows in the form of a slide bearing. Preferably, a sleeve 13 is mounted on the pump bearing support 12 as a bearing axis, in the present case by means of a set screw 14. The connecting surfaces between sleeve 13 and pump bearing support 12 or the head of the set screw 14 are sealed by O-rings 15.

A metal sleeve 17, which has thin walls by comparison to bearing bushing 16, is shrunk onto the bearing bushing 16 to be connected with pump rotor 8. Metal sleeve 17 preferably consists of a material with a high creep limit, good heat strength, good corrosion resistance, and preferably a thermal heat expansion coefficient which is in the vicinity of the thermal expansion coefficient of the bearing bushing 16. The shrinking process and the dimensions of metal sleeve 17 are designed so that they are at least partially plastically deformed, and preferably completely plastically deformed. A favorable stress distribution is achieved by this metal sleeve 17 on bearing bushing 16, said distribution having no stress peaks. By choosing the wall thickness of metal sleeve 17, advantageously utilizing the maximum permissible strength values, in other words the defined plastic deformation, the pressure on the bearing bushing 16 can be adjusted or limited.

This bearing combination of bearing bushing 16 and metal sleeve 17 can now be inserted into the space provided in pump rotor 8 for this purpose and connected with the rotor 8 by a weld between metal sleeve 17 and pump rotor 8. This weld likewise serves to seal the gap between metal sleeve 17 and serves to mount pump rotor 8, preventing the formation of dead spaces in this area. As a result of this type of connection, the direct shrinking of bearing bushing 16 into the pump rotor can be avoided, which would not be feasible for the present use of ceramic material or hard metal for the bearing bushing 16. Specifically, unacceptably high stress peaks would be produced during the shrinking process and there would be the risk during operation that at high temperature the press fit would be relaxed in such fashion that the medium to be delivered would penetrate the resultant gap. As a result, the pump could no longer be reliably cleaned and disinfected.

The pump rotor 8 provided with the bearing combination can then be pushed onto the sleeve 13 of the pump bearing support 12 in order to form a flying bearing. This bearing is advantageously made very compact, resulting in good contact and bypass flow conditions during the cleaning process and no dead spaces, and is located in the vicinity of the medium to be pumped, so that even when pump chamber 2' is refilled, no problems can occur as a result of deficient venting in this area.

Figure 2:
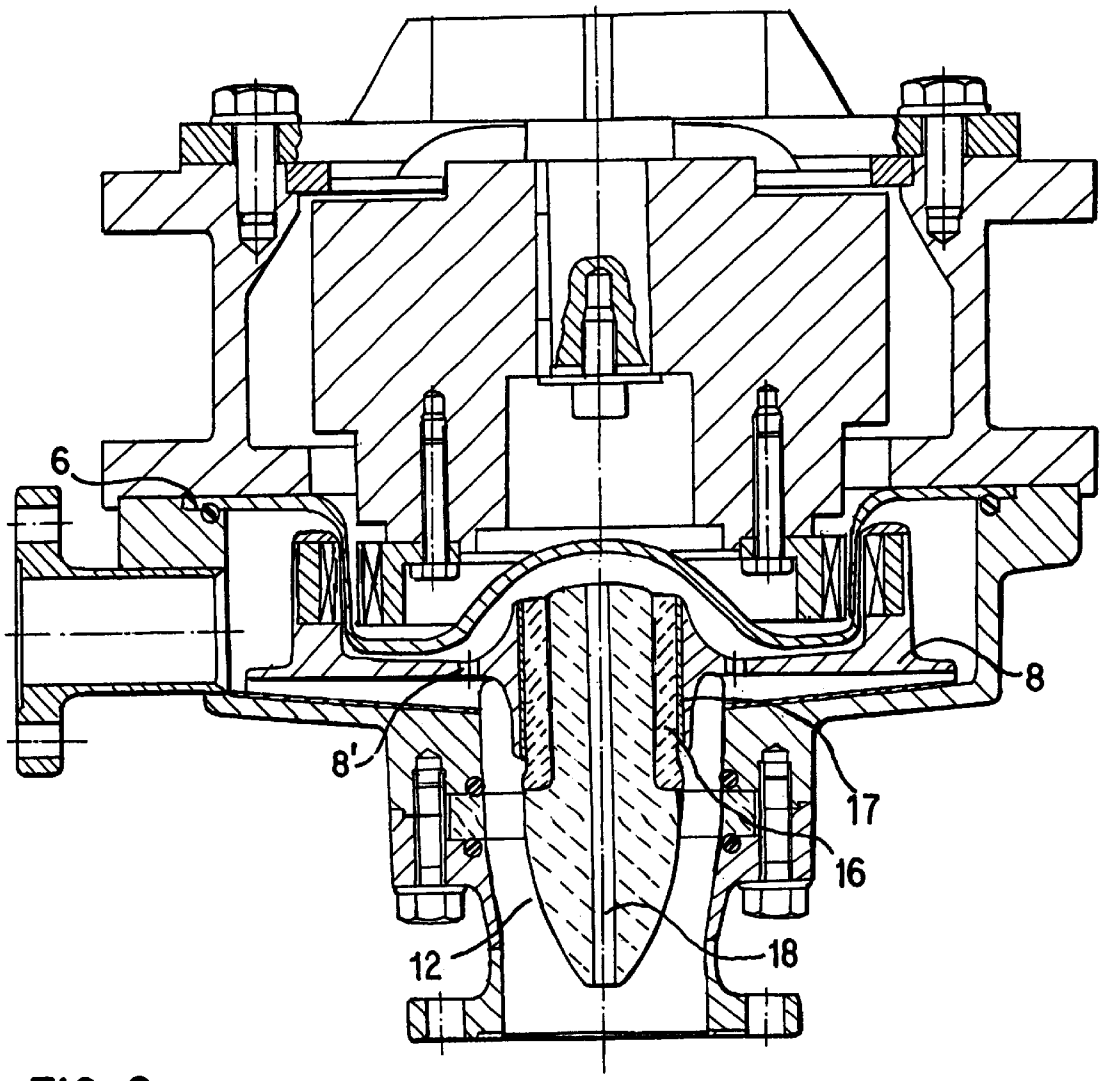
FIG. 2 shows a lengthwise section through a pump according to the invention with a one-piece pump bearing support.

FIG. 2 shows another preferred embodiment of the present invention. In this embodiment, the pump bearing support 12 is made in one piece simultaneously also as a bearing axis in the vicinity of bearing bushing 16. This embodiment is simplified further by comparison with the design in FIG. 1 and can be cleaned and possibly also disassembled more simply. Advantageously, in this case a through bore 18 can be formed in the pump bearing support 12, which simplifies the cleaning of the pump chamber and during operation serves to equalize the pressure between the intake area 3' and the back of the pump rotor 8.

The pump shown here, because of its simple and compact design and the avoidance of dead spaces and gaps, is especially suitable for sterile applications, but of course can also be used for other applications.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotary pump, comprising:

a can motor housing sealing a pump chamber on a drive side from a pumped medium, a motor-driven permanent magnet rotor being located on one side of the can motor housing and another permanent magnet rotor, connected with a pump rotor, being located on the other side, the can motor housing being connected only at an edge area with pump housing parts, the pump rotor, on a side facing away from the can motor housing in a hub area facing an intake channel, being rotatably mounted on a fixed axis of a pump bearing support, which support is located in an intake chamber and is permanently connected with a housing of the rotary pump, and wherein a bearing bushing is connected with the pump rotor via a sleeve, said sleeve being made of metal shrunk over a bearing bushing and, in cooperation with a bearing axis located on the pump bearing support, forms one single slide bearing of the pump rotor.

2. Rotary pump according claim 1, wherein the sleeve has a wall thickness that is several times thinner by comparison with the bearing bushing.

3. Rotary pump according to claim 1, wherein the sleeve comprises a metal material with a high creep limit, high heat strength, and good resistance to corrosion by fluids.

4. Rotary pump according to claim 1, wherein the sleeve has approximately the same thermal expansion coefficient as the bearing bushing.

5. Rotary pump according to claim 1, wherein the sleeve is designed with a length that is at most equal to the bearing bushing.

6. Rotary pump according to claim 1, wherein the sleeve is designed with a length that is shorter than the bearing bushing.

7. Rotary pump according to claim 1, wherein the sleeve is one of the same length as and longer than the hub of the pump rotor into which the sleeve is inserted.

8. Rotary pump according to claim 1, wherein the sleeve is connected with the pump rotor along both sleeve edges by welds.

9. Rotary pump according to claim 8, wherein the welds are fluid-tight welds.

10. Rotary pump according to claim 1, wherein the bearing bushing comprises a ceramic material or hard metal.

11. Rotary pump according to claim 1, wherein a bearing pin surface is formed by a bushing located concentrically on the stationary axis of the pump bearing support.

12. Rotary pump according to claim 11, wherein the bushing is tensioned via a screw against the stationary axis of the pump bearing support and is sealed-off therefrom by seals.

13. Rotary pump according to claim 12, wherein the seals are O-rings.

14. Rotary pump according to claim 1, wherein the slide bearing surface is formed by the stationary axis of the pump bearing support itself in a one-piece design.

15. Rotary pump according to claim 1, wherein bottoms of blades of the pump rotor, at least in a vicinity of the pump rotor hub, have through openings.

16. Rotary pump according to claim 1, wherein the pump rotor axis is aligned vertically during operation.

* * * * *